US007859398B2

(12) United States Patent
Davidson et al.

(10) Patent No.: US 7,859,398 B2
(45) Date of Patent: Dec. 28, 2010

(54) SYSTEM AND METHOD FOR MAINTAINING AND CONTROLLING A PLURALITY OF WIRELESS LIGHT FIXTURES

(75) Inventors: David L. Davidson, Camden, SC (US); Charles J. Luebke, Sussex, WI (US)

(73) Assignee: Eaton Corporation, Cleveland, OH (US)

( * ) Notice: Subject to any disclaimer, the term of this patent is extended or adjusted under 35 U.S.C. 154(b) by 1049 days.

(21) Appl. No.: 11/610,070

(22) Filed: Dec. 13, 2006

(65) Prior Publication Data

US 2008/0143273 A1 Jun. 19, 2008

(51) Int. Cl.
*G08B 1/08* (2006.01)
*G08B 13/02* (2006.01)
*G08B 21/00* (2006.01)

(52) U.S. Cl. ..... 340/539.1; 340/539.22; 340/641; 340/642; 340/286.02

(58) Field of Classification Search ..... None
See application file for complete search history.

(56) References Cited

U.S. PATENT DOCUMENTS 5,726,644 A 3/1998 Jednacz et al.
5,848,054 A 12/1998 Mosebrook et al.
5,898,733 A 4/1999 Satyanarayana
6,340,864 B1 1/2002 Wacyk
6,445,690 B2 9/2002 Sato et al.
6,445,691 B2 9/2002 Sato
6,604,163 B1 8/2003 Duboc
6,687,487 B1 2/2004 Mosebrook et al.
6,701,526 B1 3/2004 Trovato
7,649,472 B1 * 1/2010 Paterno ..... 340/815.45
2005/0154494 A1 * 7/2005 Ahmed ..... 700/275
2007/0040513 A1 * 2/2007 Cleland et al. ..... 315/159
2007/0043541 A1 * 2/2007 Cleland et al. ..... 702/188
2007/0070571 A1 * 3/2007 Gordin et al. ..... 361/189
2008/0116826 A1 * 5/2008 Mehta et al. ..... 315/308
2008/0228508 A1 * 9/2008 Lyons et al. ..... 705/1

* cited by examiner

*Primary Examiner*—Julie Lieu
(74) *Attorney, Agent, or Firm*—Martin J. Moran

(57) ABSTRACT

A method of maintaining and controlling a plurality of wireless light fixtures includes providing the light fixtures in a structure, wirelessly receiving respective operational data from each of the light fixtures at a central location, aggregating the received respective operational data to form an aggregation of operational data, and analyzing at least a portion of the aggregation of operational data. The method further includes performing one or both of (i) controlling the operation of a first selected one or more of the light fixtures based on a result of the analyzing step by wirelessly transmitting respective operational commands from the central location to each of the first selected one or more of the light fixtures, and (ii) causing a maintenance related action to be taken with respect to each of a second selected one or more of the light fixtures based on a result of the analyzing step.

12 Claims, 2 Drawing Sheets

SYSTEM AND METHOD FOR MAINTAINING AND CONTROLLING A PLURALITY OF WIRELESS LIGHT FIXTURES

BACKGROUND OF THE INVENTION

1. Field of the Invention

The present invention relates to lighting systems, and in particular to a system and method for controlling and maintaining a plurality of wireless light fixtures provided within a structure.

2. Description of the Prior Art

In known, prior art lighting systems, a large number of lighting fixtures are provided within a structure in various locations. Typically, the lighting fixtures are segregated into a number of groups of fixtures, wherein in each group, each fixture is connected to a circuit breaker. Groups of certain breakers are then typically connected to a smart panel board which is then typically hardwired to a control system of some type. Each smart panel board makes up what is typically referred to as a breaker zone, allowing the control system to control the lighting system on a breaker zone basis. In particular, each smart panel board may be used to selectively turn circuit breakers ON and OFF, alone or in groups, to allow the light fixtures to be selectively controlled on a circuit breaker by circuit breaker basis. One problem with such a configuration is that the components are hardwired together, which makes reconfiguring the system both time consuming and difficult.

More recently, wireless lighting fixtures have been developed that allow light fixtures to be controlled, configured, commissioned, grouped, etc. individually using a handheld control device that is brought into close proximity with each fixture in order to transmit wireless control signals to each fixture. In addition, such wireless lighting fixtures are "smart," meaning they are capable of collecting certain operational data relating to the fixture. That operational data (for each fixture) may also be collected by the handheld electronic device. The mere collection of such data in this manner, while somewhat useful, does not take full advantage of the data that is available. There is thus a need for a system that is able to remotely and wirelessly collect operational data for a plurality of fixtures, aggregate and analyze the data, and take certain actions based thereon, such as taking certain maintenance or operational actions with respect to the lighting system.

SUMMARY OF THE INVENTION

In one embodiment, the invention provides a method of maintaining and controlling a plurality of light fixtures having wireless communications capabilities. The method includes providing the light fixtures in a structure, wirelessly receiving respective operational data from each of the light fixtures at a central location, aggregating the received respective operational data at the central location to form an aggregation of operational data, and analyzing at least a portion of the aggregation of operational data at the central location. In addition, the method further includes performing one or both of (i) controlling the operation of a first selected one or more of the light fixtures based on a result of the analyzing step by wirelessly transmitting respective operational commands from the central location to each of the first selected one or more of the light fixtures, and (ii) causing a maintenance related action to be taken with respect to each of a second selected one or more of the light fixtures based on a result of the analyzing step.

In another embodiment, the invention provides a lighting system that includes a plurality of light fixtures provided in a structure, wherein each of the light fixtures has a processing unit operatively coupled to one or more light bulbs and a wireless communications device in electronic communication with the processing unit. The system further includes a central controller located at a central location, wherein the central controller has a wireless communications capability. The central controller wirelessly receives respective operational data from each of the light fixtures, aggregates the received respective operational data to form an aggregation of operational data and analyzes at least a portion of the aggregation of operational data. In addition, the central controller does one or both of the following based on a result of the analyzing of the at least a portion of the aggregation of operational data: (i) wirelessly transmits respective operational commands to a first selected one or more of the light fixtures for controlling the operation of the first selected one or more of the light fixtures, and (ii) directs or recommends that a maintenance related action be taken with respect to each of a second selected one or more of the light fixtures.

In still another embodiment, the invention provides a method of controlling a plurality of light fixtures having wireless communications capabilities including providing the light fixtures in a structure, and providing one or more light level sensors in the structure, each of the one or more light level sensors measuring ambient light level data and having wireless communications capabilities. The method further includes wirelessly receiving at a central location from each of the one or more light level sensors the ambient light level data measured thereby, aggregating the received ambient light level data at the central location to form an aggregation of light level data, analyzing at least a portion of the aggregation of light level data, and controlling the operation of a selected one or more of the light fixtures based on a result of the analyzing step by wirelessly transmitting respective operational commands from the central location to each of the selected one or more of the light fixtures.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
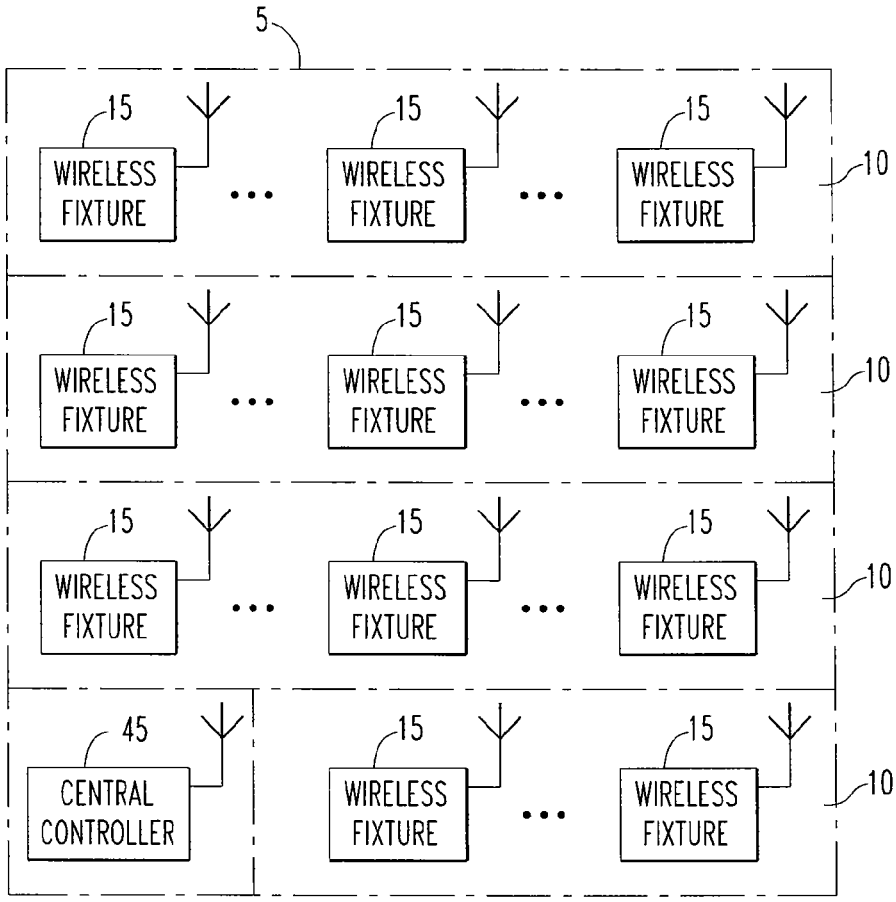
FIG. 1 is a schematic representation of a structure according to an embodiment of the present invention.

FIG. 1 is a schematic representation of a structure 5 according to an embodiment of the present invention. As employed herein, the term "structure" shall expressly include, but not be limited by, a home, apartment, dwelling, garage, office building, commercial building, industrial building, of a roofed and/or walled structure built for permanent or temporary use. The structure 5 may include a number of subdivisions 10, which may be, without limitation, a floor of the structure 5 or a particular room within the structure 5. As seen in FIG. 1, each subdivision 10 within the structure 5 includes one or more wireless fixtures 15 (shown in greater detail in FIG. 2 and described below). For example, a subdivision 10 may be a particular floor that includes within it multiple wireless fixtures 15 or, alternatively, a room such as a conference room or storage room, located on a particular floor that includes within it multiple wireless fixtures 15.

Figure 2:
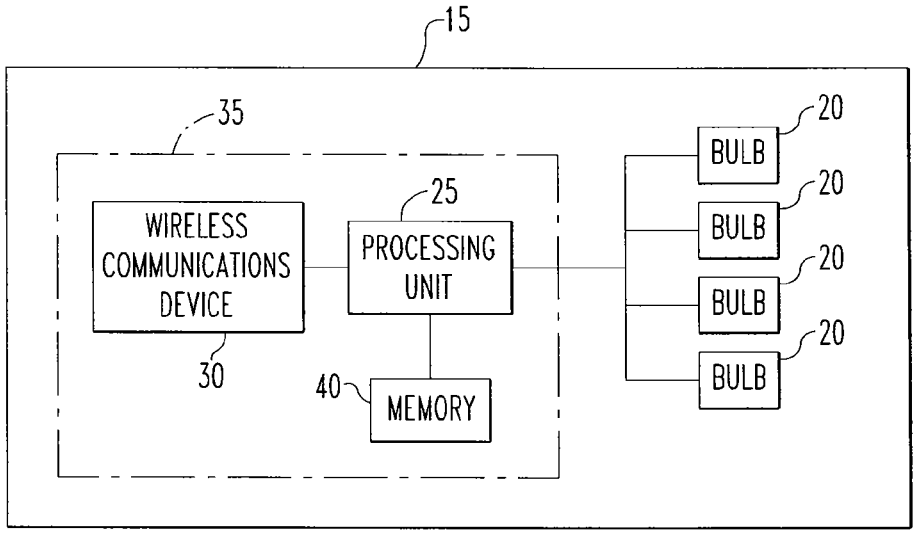
FIG. 2 is a block diagram showing certain components of a wireless fixture provided within the structure shown in FIG. 1.

Referring to FIG. 2, each wireless fixture 15 includes a plurality of light bulbs (or lamps) 20 (and as such is a wireless lighting fixture), which may be any type of known light bulb for providing light such as, without limitation, a fluorescent or incandescent bulb. Each wireless fixture 15 also includes a processing unit 25, such as, without limitation, a microprocessor or microcontroller, and a wireless communications device 30. Together, the processing unit 25 and the wireless communications device 30 form part of what is commonly known as a ballast 35. The wireless communications device 30 enables the wireless fixture 15 to wirelessly transmit and receive data (as described elsewhere herein) using a wireless communications protocol. The wireless communications protocol may be any known or hereafter developed protocol such as, without limitation, any of a variety of known RF communications protocols. Thus, as employed herein, the term "wireless" shall expressly include, but not be limited by, radio frequency (RF), infrared, wireless area networks, IEEE 802.11 (e.g., 802.11a; 802.11b; 802.11g), IEEE 802.15 (e.g., 802.15.1; 802.15.3, 802.15.4), and other wireless communication standards (e.g., without limitation, ZigBee™ Alliance standard, DECT, PWT, pager, PCS, Wi-Fi, Bluetooth™, and cellular). For this purpose, the wireless communications device 30 may be a commercially available transceiver (e.g., RF) device or may include a separate commercially available transmitting (e.g., RF) device and a separate commercially available receiving (e.g., RF) device. As seen in FIG. 2, the wireless communications device 30 is in electronic communication with the processing unit 25 and, as a result, is able to provide data to and receive data from the processing unit 25. In addition, the ballast 35 may be independently powered by, for example, a battery (not shown), in which case it is able to function when the bulbs 20 are in an OFF state. Alternatively, the ballast 35 may be powered via "the mains", yet still have the ability to turn ON, OFF, and dim the bulbs 20 in the wireless fixture 15. When the bulbs 20 are OFF, the ballast 35 can be in a low power mode, but still have the ability to receive wireless commands and act on them as described herein. In addition, the ballast 35 may also wake up (i.e., leave the low power mode) periodically and broadcast its status to the central controller 45 as described elsewhere herein.

As also seen in FIG. 2, the processing unit 25 is operatively coupled to each light bulb 20 and is able to selectively control the operation of the light bulbs 20. For example, the processing unit 20 is able to selectively turn the light bulbs 20 ON and OFF and, preferably, dim the light bulbs 20 by controlling the amount of current that is provided to the light bulbs 20 from a source of power (e.g., the "mains", not shown). In addition, the processing unit 25 is able to collect various types of operational data relating to the operation of the wireless fixture 15 such as, without limitation, the number of hours (e.g., within a particular time frame) that the bulbs 20 are operational (i.e., turned ON), the energy/power consumed by the wireless fixture 15 (a small meter may be provided in the wireless fixture 15 for this purpose), the number of starts (i.e., moving from an OFF to an ON condition) experienced by the bulbs 20 (e.g., within a particular time frame), and the voltage and/or current consumed by the wireless fixture 15 (e.g., within a particular time frame), among others. For this purpose, the processing unit 25 is in electronic communication with a memory 40 provided within the ballast 35 for storing such collected data. Preferably, the memory 40 also stores the various software routines (which may include one or more subroutines, processes, procedures, function calls or the like, alone or in combination) that are executable by the processing unit 25 for controlling the operation of the wireless fixture 15 as described herein. The memory 40 can be any of a variety of types of internal and/or external storage media such as, without limitation, RAM, ROM, EEROM's, EEPROM's, and the like, alone or in combination.

Referring again to FIG. 1, the structure 5 also includes a central controller 45, which may be, without limitation, a suitable computing device having a suitable processor or processing capability such as a PC or server computer. Also, the central controller 45 includes wireless communications capability. In particular, and according to an aspect of the invention, the central controller 45 is able to selectively wirelessly transmit data to and selectively wirelessly receive data from each of the wireless fixtures 15 provided within the structure 5 through, for example, a wireless communications device that is similar to the wireless communications device 30. For this purpose, each wireless fixture 15 may be uniquely identified within the structure 5, such as by a unique ID number or serial number associated therewith. As a result, each wireless fixture 15 may be separately addressable by the central controller 45 so that the central controller 45 can selectively wirelessly transmit operational commands to each wireless fixture 15 to independently control the operation thereof. As will be appreciated, the operational commands will be received by the wireless communications device 30 and subsequently provided to the processing unit 25 of the appropriate wireless fixture 15, which in turn will control the operation of the wireless fixture 15 in an appropriate manner (based on the received operational commands). In this manner, individual and/or selected groups of wireless fixtures 15 may be selectively controlled by the central controller 45. For example, the central controller 45, by issuing the appropriate operational commands, may cause all (or selected ones) of the wireless fixtures 15 within a particular subdivision 10 of the structure 5 to operate in a certain manner, e.g., to be turned ON, turned OFF, or dimmed at a particular time (for instance, the following is a command that may be issued: turn all light bulbs 20 ON at 70 percent power in those wireless fixtures 15 that are located in conference room #2 at noon).

In addition, according to a further aspect of the present invention, portions of or all of the operational data that is collected by the processing unit 25 (and preferably stored in the memory 40) of each wireless fixture 15 may be periodically wirelessly transmitted to the central controller 45. In response, the central controller 45 may store the collected operational data, aggregate and/or analyze the collected operational data, and make maintenance decisions/recommendations (e.g., alerts for actions to be taken by maintenance personnel) relating to selected ones or groups of the wireless fixtures 15 based on the aggregated and/or analyzed operational data that has been collected. For instance, if, based on the aggregated data, the central controller 45 determines that more than a certain percentage of wireless fixtures is (e.g., 75 percent) in a particular subdivision 10 of the structure 5 have more than a certain number of operational hours, or, alternatively, that a certain number (e.g., 30 percent) of light bulbs 20 in those wireless fixtures 15 are beyond their useful life, then an alert may be provided by the central controller 45 to, for example, a maintenance manager that all of the light bulbs 20 in the wireless fixtures 15 in the subdivision 10 should be replaced. This is advantageous as it is more efficient, and therefore reduces labor and/or maintenance costs, to change a larger number of light bulbs 20 at a single time (even if some of the bulbs still have life remaining) than to do so piece-meal. Similarly, as another example, the central controller 45 can, based on the aggregated data, analyze the energy consumed by selected ones or groups of the wireless fixtures 15 and issue operational commands (e.g., turn ON, OFF or dim) aimed at conserving energy to selected ones or groups of the wireless fixtures 15. Alternatively, this same energy consumption information may be used to pinpoint energy consumption levels to particular selected ones or groups of the wireless fixtures 15, and operational and/or maintenance decisions/recommendations/schedules (e.g., to replace certain bulbs 20 or wireless fixtures 15) may be made by the central controller 45 in response thereto. Furthermore, lumen depreciation may be calculated based on measuring or calculating lumen output from the wireless fixtures 15, predicted Remaining Useful Life (RUL) of the bulbs 20 may be calculated based on information obtained form the ballast 35 by knowing the lamp type of the bulbs 20 in question and the operating conditions relating thereto, predicted Remaining Useful Life (RUL) of the ballasts 35 may be calculated based on the operating conditions relating thereto, including temperature.

Another advantage of the configuration of the structure 5 shown in FIG. 1 is that, since each wireless fixture 15 may be independently and separately controlled by the central controller 45 and may independently transmit data to the central controller 45, the structure 5 may be readily reconfigured on a per-fixture basis as necessary. In other words, groupings of particular wireless fixtures 15 for the purposes described herein may be easily changed without the need to revise the structure 5. This may be necessary, for example, as tenants within the structure 5 acquire more or less space. In such a case, the various subdivisions 10 within the structure 5 may be reconfigured so that a wireless fixture 15 formerly associated with one subdivision 10 may be now associated with another subdivision 10.

Figure 3:
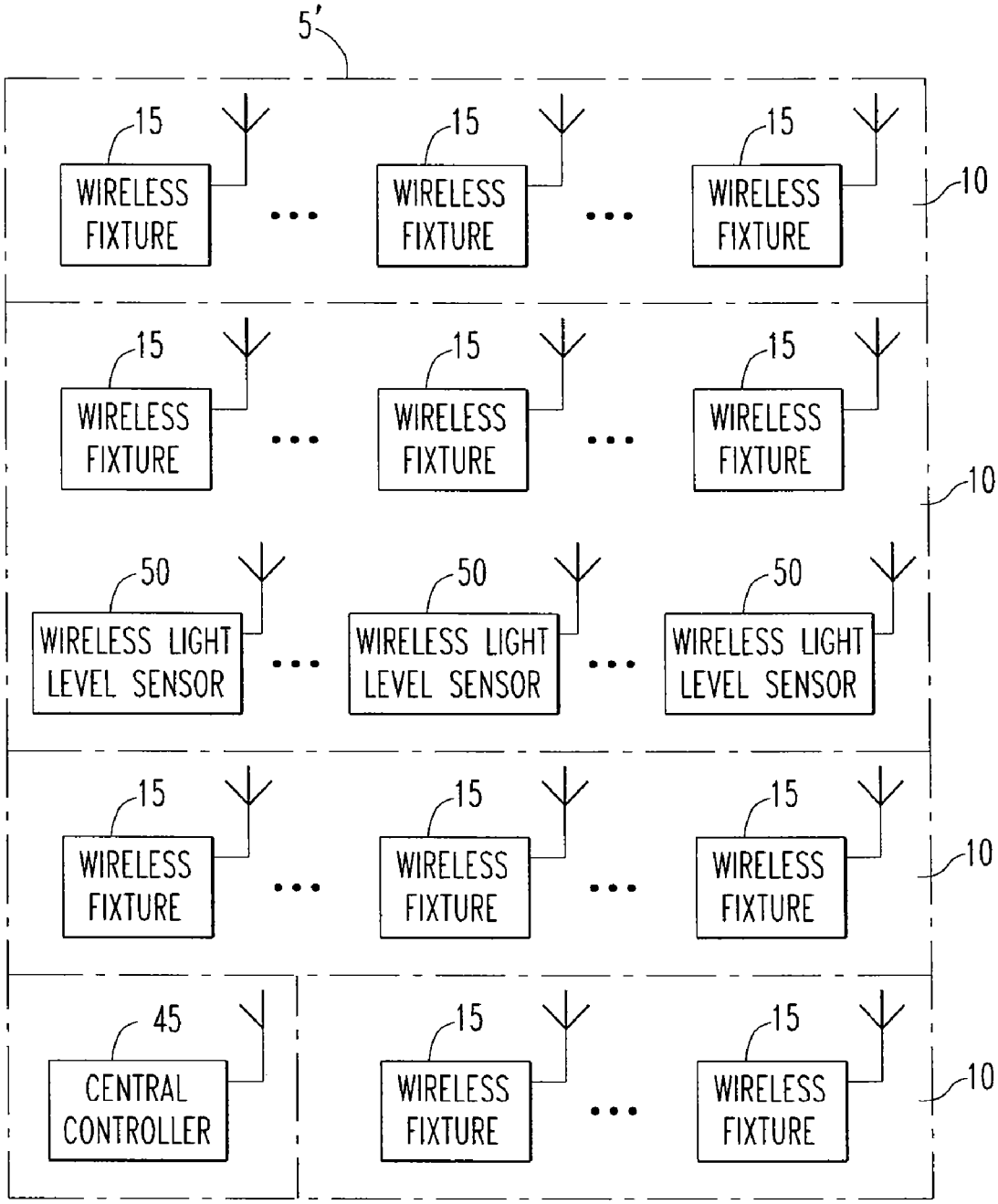
FIG. 3 is a schematic representation of a structure according to an alternative embodiment of the present invention.

FIG. 3 is a schematic representation of a structure 5' according to an alternate embodiment of the invention. The structure 5' is similar to the structure 5 shown in FIG. 1 and, as seen in FIG. 3, includes many of the same components. The structure 5' differs from the structure 5 in that one or more subdivisions 10 thereof include one or more wireless ambient light level sensors 50. Each ambient light level sensor 50 is adapted to measure (and accumulate data relating to) the amount of light entering the structure 5' in the vicinity of the ambient light level sensor 50. Each ambient light level sensor 50 is also adapted to wirelessly transmit the light level data it collects to the central controller 45. In this manner, the central controller 45 is able to collect such data from each wireless light level sensor 50, aggregate the collected data and, based on an analysis of aggregated data wirelessly control the operation of selected ones or groups of wireless fixtures 15 to reduce the light being output thereby (by the bulbs 20 thereof) in order to reduce energy consumption and/or heat generation. One advantage of this configuration is that the groups of wireless fixtures 15 that may be controlled in this manner can be completely different than other preselected groups of wireless fixtures 15 that are grouped together for control by, for example, a switch or motion sensor. For example, a row of offices along an outside wall may all have individual room controls, but the first row of wireless fixtures 15 (or selected bulbs 20 therein) may be commanded to reduce light level to 60 percent, the second row of wireless fixtures 15 (or selected bulbs 20 therein) may be commanded to reduce light level to 70 percent, and the third row of wireless fixtures 15 (or selected bulbs therein) may be commanded to reduce light level to 80 percent.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A method of maintaining and controlling a plurality of light fixtures, said light fixtures having wireless communications capabilities, comprising:

providing said light fixtures in a structure;

determining in a processing unit of each of said light fixtures operational data relating to an extent of usage of the light fixture over a period of time, the operational data for each light fixture including one or more of: (i) a number of hours that each of one or more bulbs the light fixture has been operational over the period of time, (ii) an amount of energy consumed by the light fixture over the period of time, and (iii) a number of starts experienced by each of one or more bulbs the light fixture over the period of time;

wirelessly receiving the respective operational data from each of said light fixtures at a central location;

aggregating the received respective operational data at said central location to form an aggregation of operational data;

analyzing at least a portion of said aggregation of operational data at said central location; and performing one or both of (i) controlling the operation of a first selected one or more of said light fixtures based on a result of said analyzing step by wirelessly transmitting respective operational commands from said central location to each of said first selected one or more of said light fixtures, and (ii) causing a maintenance related action to be taken with respect to each of a second selected one or more of said light fixtures based on a result of said analyzing step.

2. The method according to claim 1, wherein said performing step comprises performing both sub-step (i) and sub-step (ii).

3. The method according to claim 1, wherein said analyzing step includes calculating a lumen depreciation for each of said second selected one or more of said light fixtures.

4. The method according to claim 1, wherein said analyzing step includes calculating a remaining useful life for one or more bulbs included in each of said second selected one or more of said light fixtures.

5. The method according to claim 1, wherein said analyzing step includes calculating a remaining useful life for one or more ballasts included in each of said second selected one or more of said light fixtures.

6. The method according to claim 1, further comprising:

providing one or more light level sensors in said structure, each of said one or more light level sensors measuring ambient light level data and having wireless communications capabilities;

wirelessly receiving at said central location from each of the one or more light level sensors the ambient light level data measured thereby;

aggregating the received ambient light level data at the central location to form an aggregation of light level data;

analyzing at least a portion of said aggregation of light level data; and controlling the operation of a third selected one or more of said light fixtures based on a result of said light level data analyzing step by wirelessly transmitting respective second operational commands from said central location to each of said third selected one or more of said light fixtures.

7. A lighting system, comprising:

a plurality of light fixtures provided in a structure, each of said light fixtures having a processing unit operatively coupled to one or more light bulbs and a wireless communications device in electronic communication with said processing unit, wherein the processing unit of each of said light fixtures determines operational data relating to an extent of usage of the light fixture over a period of time, the operational data for each light fixture including one or more of: (i) a number of hours that each of one or more bulbs the light fixture has been operational over the period of time, (ii) an amount of energy consumed by the light fixture over the period of time, and (iii) a number of starts experienced by each of one or more bulbs the light fixture over the period of time; and a central controller located at a central location, said central controller having a wireless communications capability;

wherein said central controller wirelessly receives respective the operational data from each of said light fixtures, aggregates the received respective operational data to form an aggregation of operational data and analyzes at least a portion of said aggregation of operational data, and wherein said central controller does one or both of the following based on a result of the analyzing of said at least a portion of said aggregation of operational data: (i) wirelessly transmits respective operational commands to a first selected one or more of said light fixtures for controlling the operation of said first selected one or more of said light fixtures, and (ii) directs or recommends that a maintenance related action be taken with respect to each of a second selected one or more of said light fixtures.

8. The system according to claim 7, wherein said central controller directs or recommends that a maintenance related action be taken with respect to each of said second selected one or more of said light fixtures by providing an alert that a particular action be taken with respect to said second selected one or more of said light fixtures.

9. The system according to claim 7, wherein said central controller does both step (i) and step (ii) based on said result.

10. The system according to claim 7, wherein when said central controller analyzes said at least a portion of said aggregation of operational data said central controller calculates a lumen depreciation for each of said second selected one or more of said light fixtures.

11. The system according to claim 7, wherein when said central controller analyzes said at least a portion of said aggregation of operational data said central controller calculates a remaining useful life for one or more bulbs included in each of said second selected one or more of said light fixtures.

12. The system according to claim 7, wherein when said central controller analyzes said at least a portion of said aggregation of operational data said central controller calculates a remaining useful life for one or more ballasts included in each of said second selected one or more of said light fixtures.

* * * * *